US006221034B1

(12) United States Patent
Chaplin

(10) Patent No.: US 6,221,034 B1
(45) Date of Patent: Apr. 24, 2001

(54) BACK SCRATCHER

(76) Inventor: Albin Chaplin, 2338 Alpine Ave, Sarasota, FL (US) 34239

( * ) Notice: Subject to any disclaimer, the term of this patent is extended or adjusted under 35 U.S.C. 154(b) by 0 days.

(21) Appl. No.: 09/309,696

(22) Filed: May 11, 1999

(51) Int. Cl.[7] ..... A61H 7/00
(52) U.S. Cl. ..... 601/137; D28/91.2
(58) Field of Search ..... 601/136–141, 601/162, 163; 15/167.1, 167.2, 143.1, 144.3, 144.4, 145; 132/308, 311, 317; D28/91.2, 99; D32/40; D4/104

(56) References Cited

U.S. PATENT DOCUMENTS

D. 392,070 * 3/1998 Pitaro et al. ..... D28/99
3,568,237 * 3/1971 Rhodes ..... 15/244.2
4,184,221 * 1/1980 Edwards ..... 15/114
4,620,528 * 11/1986 Arraval ..... 604/162
5,138,737 * 8/1992 Thomas ..... 15/143.1
5,382,222 * 1/1995 Yih-Jong ..... 601/135
5,383,244 * 1/1995 Ahrens et al. ..... 15/106
5,444,889 * 8/1995 Barre ..... 15/167.1
5,590,436 * 1/1997 Wright et al. ..... 15/105
5,659,916 * 8/1997 Beatty et al. ..... 15/210.1
5,673,455 * 10/1997 Per-Lee et al. ..... 15/210.1
5,779,653 * 7/1998 Thompson ..... 601/136

* cited by examiner

*Primary Examiner*—Danton D. DeMillle
*Assistant Examiner*—Denise Pothier
(74) *Attorney, Agent, or Firm*—Charles J. Prescott

(57) ABSTRACT

A back scratcher including an elongated slender stem having a handle disposed at a first end thereof and a scratching head disposed at a second end of said stem. The stem includes a substantially arcuate form, the handle and the scratching head being oriented at an obtuse angle one to another thereby. The scratching head has bristles extending laterally therefrom. The handle has an elongated handle portion extending in either direction from the first end and a plane defined by said stem whereby, when the handle is grasped with one hand portion placed against the palm of the user and a finger is positioned along the other handle portion and the stem is placed over the shoulder or around the waist, the bristles are aligned to engage the back of the user. The stem is preferably further defined by a substantially uniform radius in a side view thereof and planar in a front view thereof. An enlargement at a distal end of each said handle portion for enhanced gripping of said handle and manipulation of said scratching head is also provided.

12 Claims, 4 Drawing Sheets

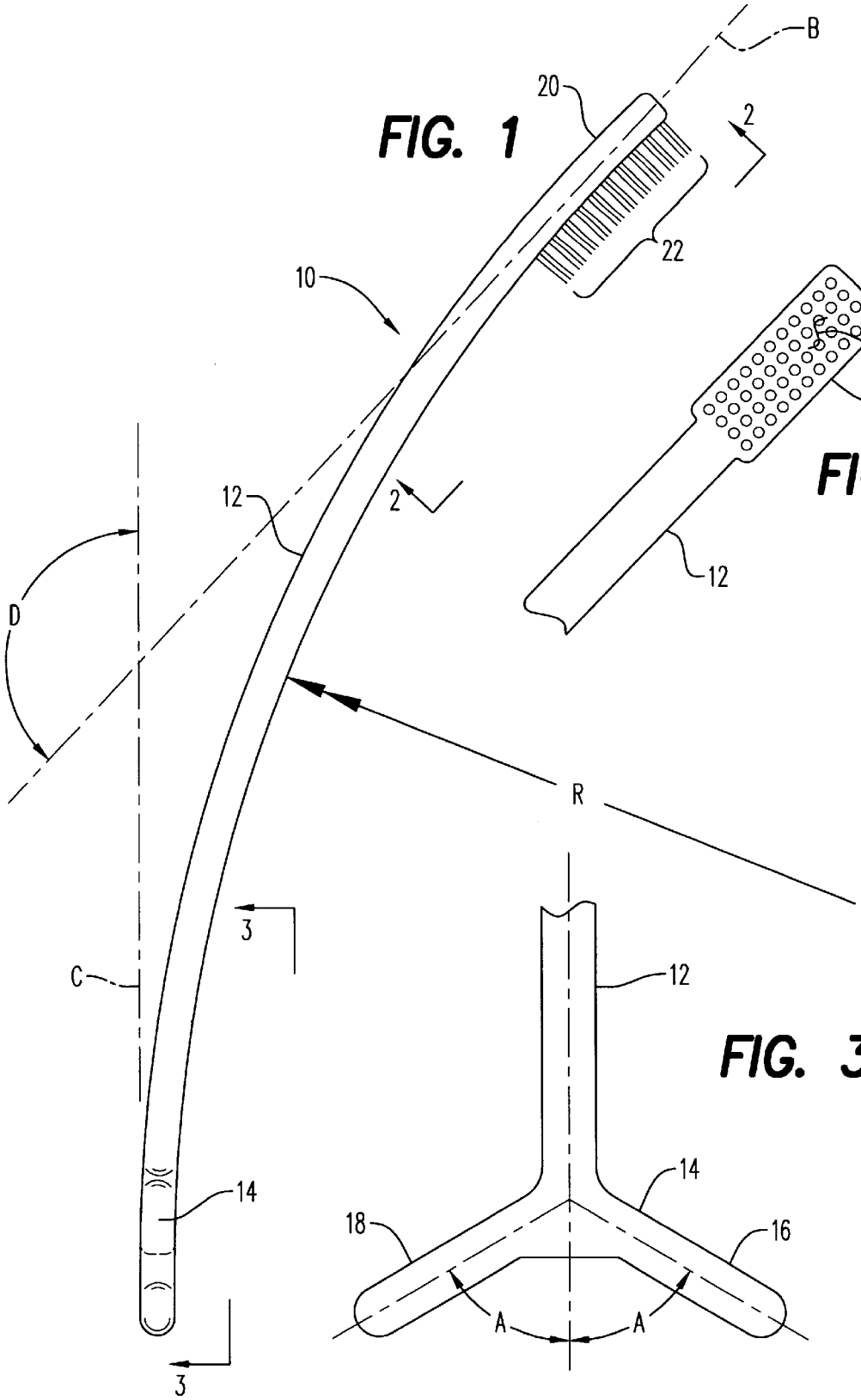
FIG. 1
B
20
2
22
10
12
2
D
R
3
C
14
3
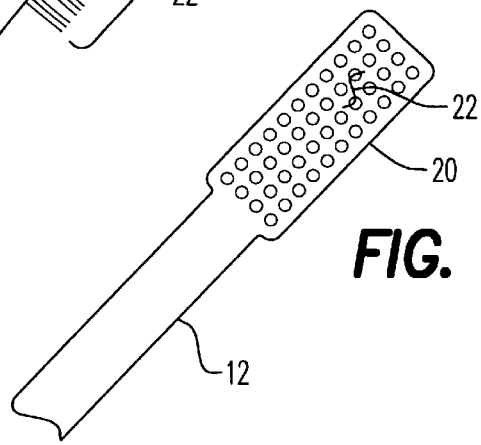
22
20
FIG. 2
12
12
FIG. 3
14
18
16
A
A

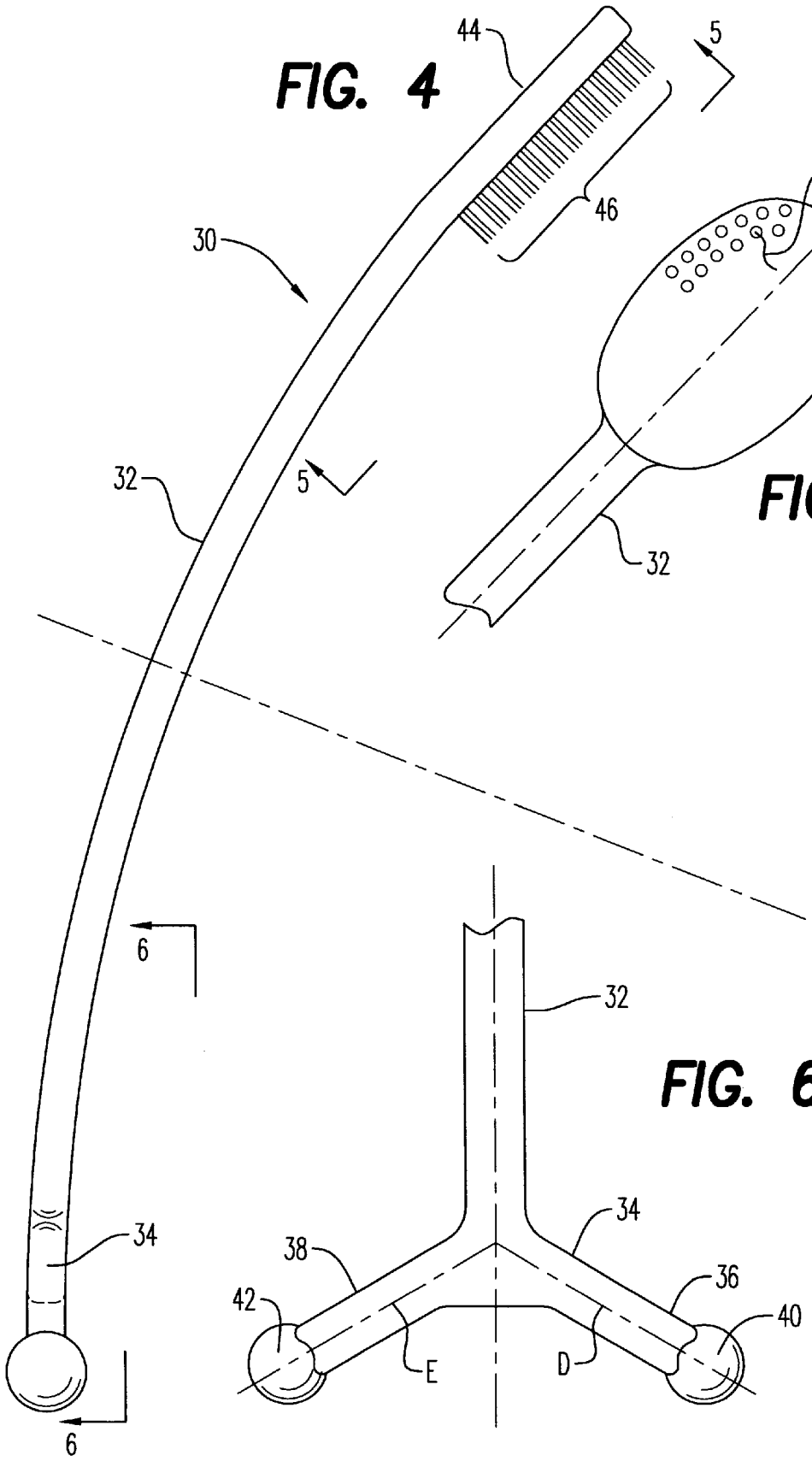
FIG. 4
44
5
46
30
32
5
6
34
6
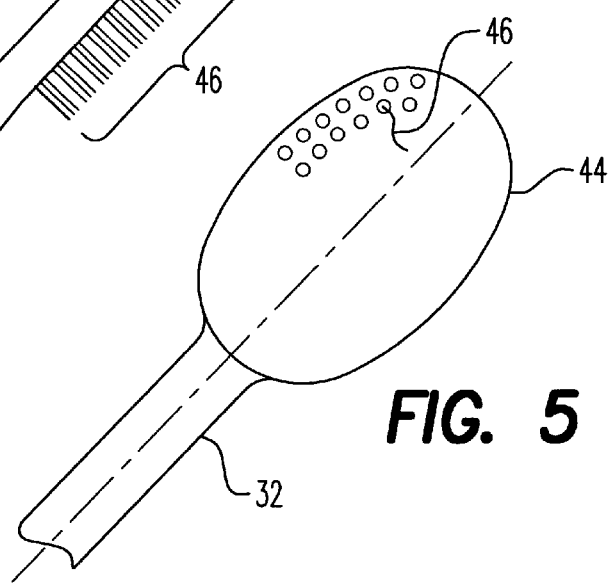
46
44
32
FIG. 5
32
FIG. 6
34
38
36
42
40
E
D 54
56
52
50

56
54
52

54
56
10
14
16
12

18

BACK SCRATCHER

BACKGROUND OF THE INVENTION

1. Scope of Invention

This invention relates generally to manual back scratchers, and more particularly to a back scratcher and scrubber which offers substantially more control and pressure during scratching and scrubbing motion.

2. Prior Art

The general notion of a back scratcher is well known. Starting with bears rubbing their backs against trees, a broad variety of devices for relieving the itch and for scrubbing the back generally are well known.

One such device is disclosed in U.S. Pat. No. 4,574,788 invented by Jordan which teaches a facile back scratcher and accompanying holder. The scratcher head includes a plurality of spaced tines extending therefrom which engage against the back. This device also includes a handle having an indentation which is thumb engageable for alignment purposes. However, very little in the way of additional rotational or lateral stability is provided thereby.

A broad array of ornamental and structure distinct back scratchers are also known to applicant as follows:

U.S. Pat. No. D392,424 issued to Burys

U.S. Pat. No. D282,007 issued to McKinney

U.S. Pat. No. D160,415 issued to Moser

U.S. Pat. No. D311,605 issued to Clayton

U.S. Pat. No. D266,280 issued to Toyama

U.S. Pat. No. D280,449 issued to Colognori

U.S. Pat. No. 5,839,146 issued to Chen

U.S. Pat. No. D312,145 issued to Murphy

However, nothing known to applicant in prior art teaches the unique combination of structural features in applicant's invention, i.e., an elongated arcuately formed stem having a handle disposed at one end and a brush-type scratching and scrubbing head disposed at the other. The arcuate configuration of the stem adapts remarkably well to the shoulders and back curvatures and the two-part handle arrangement provides significantly improved orientation and stability during use of the device.

BRIEF SUMMARY OF THE INVENTION

This invention is directed to a back scratcher including an elongated slender stem having a handle disposed at a first end thereof and a scratching head disposed at a second end of said stem. The stem includes a substantially arcuate form, the handle and the scratching head being oriented at an obtuse angle one to another thereby. The scratching head has bristles extending laterally therefrom. The handle has an elongated handle portion extending in either direction from the first end and a plane defined by said stem whereby, when the handle is grasped with one hand portion placed against the palm of the user and a finger is positioned along the other handle portion and the stem is placed over the shoulder or around the waist, the bristles are aligned to engage the back of the user. The stem is preferably further defined by a substantially uniform radius in a side view thereof and planar in a front view thereof. An enlargement at a distal end of each said handle portion for enhanced gripping of said handle and manipulation of said scratching head is also provided.

It is therefore an object of this invention to provide a back scratcher having a uniquely configured arcuately formed stem which effectively conforms to the shoulders and back of the user to facilitate better pressure regulation of the bristles of the scrubber head against all parts of the lower and upper back areas.

It is yet another object of this invention to provide a back scratcher having a uniquely configured handle which substantially improves orientational positioning of the scratcher head and increases the pressure and controlled movement for heightened effectiveness.

It is still another object of this invention to provide a broad array of bristled scratcher heads for various uses.

Yet another object of the invention is to provide a back scratcher with a relatively narrow bristle brush head in one embodiment which faciltiates the use of the back scratcher while wearing clothing.

It is still another object of this invention to provide a back scratcher which may also be used very effectively in scrubbing the legs while in a shower or bathtub.

In accordance with these and other objects which will become apparent hereinafter, the instant invention will now be described with reference to the accompanying drawings.

BRIEF DESCRIPTION OF THE DRAWINGS

FIG. 1 is a side elevation view of the preferred embodiment of the invention.

FIG. 2 is a view in the direction of arrows 2—2 in FIG. 1.

FIG. 3 is a view in the direction of arrows 3—3 in FIG. 1.

FIG. 4 is a side elevation view of another embodiment of the invention.

FIG. 5 is a view in the direction of arrows 5—5 in FIG. 4.

FIG. 6 is a view in the direction of arrows 6—6 in FIG. 4.

DETAILED DESCRIPTION OF THE INVENTION

Figures 7, 8, 9, 10:
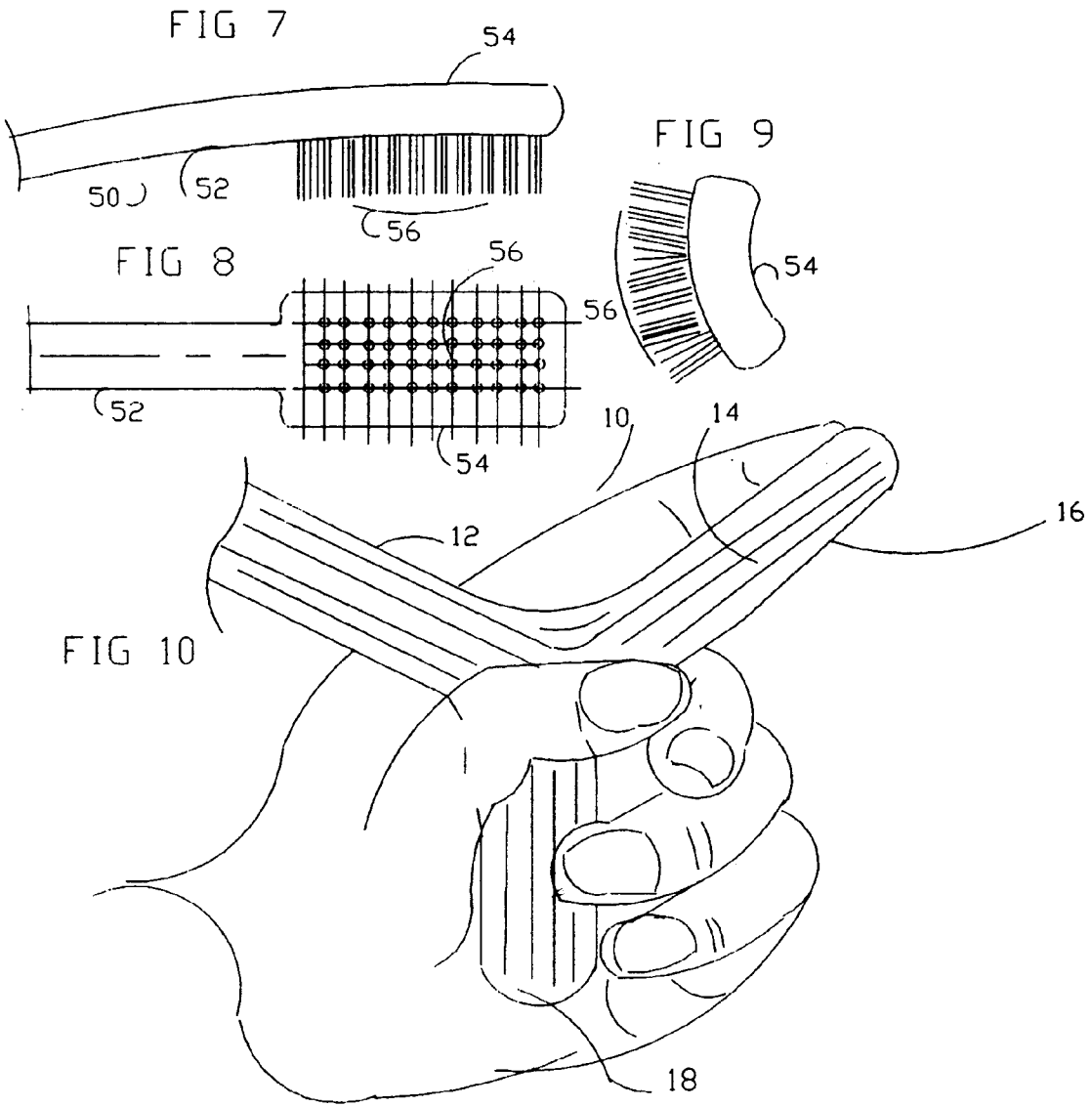
FIG. 7 is a side elevation view of a scratching head portion of another embodiment of the invention.
FIG. 8 is a front elevation view of FIG. 7.
FIG. 9 is an end elevation view of FIG. 8.
FIG. 10 is a perspective view of the handle and stem portion of the preferred embodiment of FIG. 1 shown properly held.

Referring now to the drawings and firstly to FIGS. 1 to 3, 10 and 11, the preferred embodiment of the invention is shown generally at numeral 10. This back scratcher 10 includes an elongated slender stem 12 of generally uniform cross section and having a generally arcuate shape when viewed from the side as best seen in FIG. 1. A scratching head 20 is disposed at one end of the stem 12 while a handle 14 is disclosed at the other end.

Figure 11:
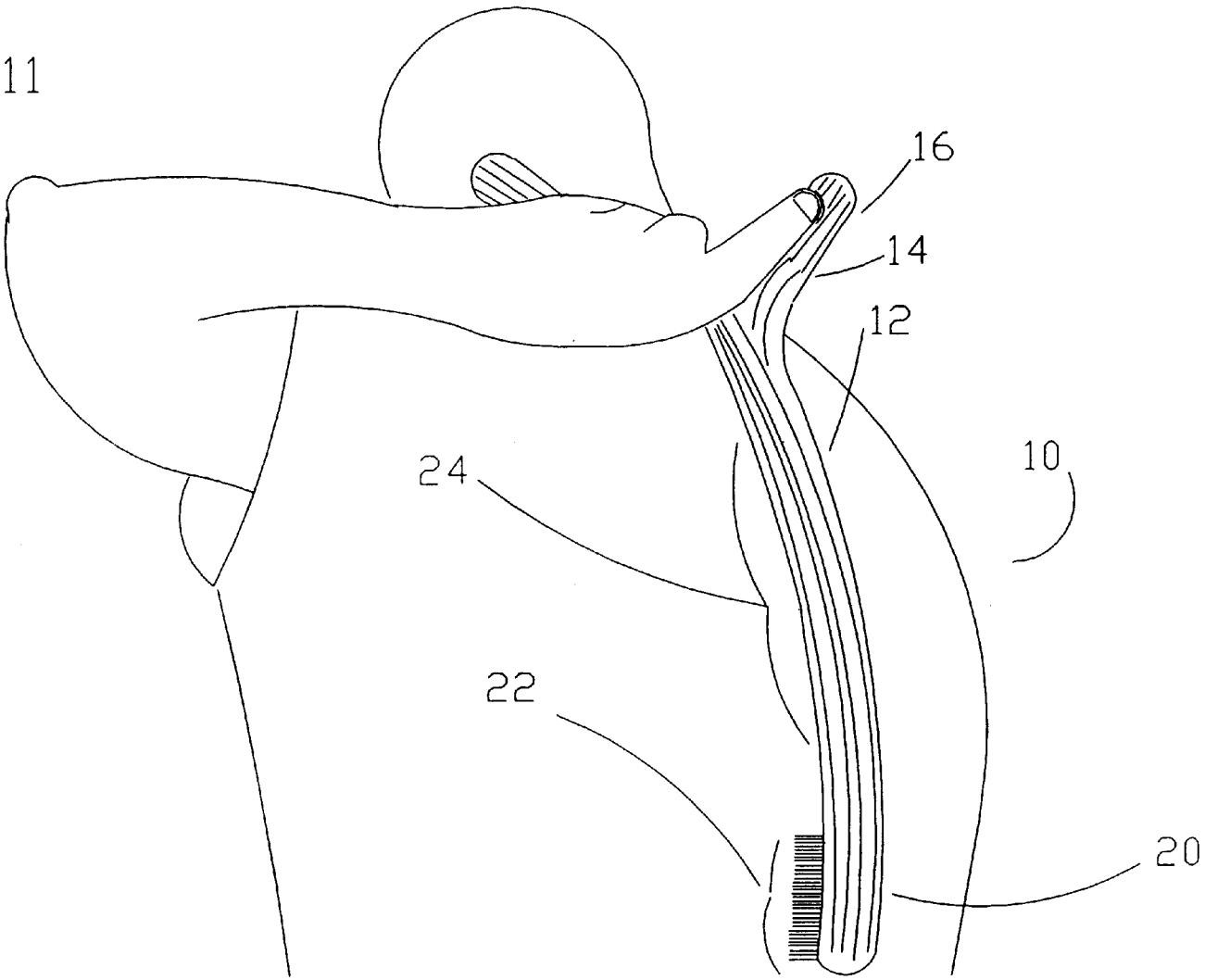
FIG. 11 is a perspective view of the embodiment of FIG. 1 in use.

The stem 12 is generally arcuate in shape as viewed from the side and preferably is of uniform radius R in the range of about 24 inches. Having a length as best seen in FIG. 11 which extends from just above the shoulders to position the scratching head 20 in the center to the lower part of the back is also preferred. By this arcuate configuration and length of the stem 12, the scratching head 20, having a longitudinal axis B, is oriented at an obtuse angle D with respect to a longitudinal axis C of the handle 14. The preferred angle D is in the range of about 1400 but may vary therefrom.

The scratching head 20 includes an array of somewhat flexible but stiff bristles 22 having a generally flat scratching surface. Bristles are preferred for both scratching and scrubbing as the "itching" occurs near the surface of the skin. The handle 14 is uniquely configured into a "Y" or "V" or "T" shape having elongated handle portions 16 and 18 extending uniformly laterally from the longitudinal axis of the stem 12 as best seen in FIG. 3. Handle portions 16 and 18 are oriented at an angle A with respect to the longitudinal axis of stem 12 and in the range of preferably about an acute angle of 60° or a total included obtuse angle of 120°.

The appropriate and recommended way to hold the back scratcher 10 by its handle 14 is best seen in FIGS. 10 and 11. By placing and finger grasping handle portion 18 against the palm of the hand and placing the index finger extending along the other handle portion 16, substantial rotational stability and scratching mobility maneuverability is achieved. As best seen in FIG. 11, rotational movement of the handle 14 is easily effected by wrist movement to effect lateral scratching movement of the bristles 22 while up and down movement of the device 10, aided by proper orientation of the bristles 22 through appropriate controlled gripping and movement of handle 14, is greatly facilitated.

Referring now to FIGS. 4 to 6, another embodiment of the invention is there shown generally at numeral 30. This embodiment 30 also includes an arcuately configured stem 32 as previously described, a scratching head 44 with an array of oval configured bristles 46 defining a generally flat scratching surface and a handle 34 disposed at the other end of stem 32.

The handle 34 includes elongated handle portions 36 and 38 as previously described. However, enlarged generally spherical-shaped portions 40 and 42, respectively are formed at the distal ends of the handle portions 36 and 38 for added control and gripability in a manner previously described. Axes D and E are again preferably orientated at an included angle of about 120° therebetween or at an obtuse angle of about this same degree amount of 120° with respect to the longitudinal axis of stem 32.

FIGS. 7, 8 and 9 describe yet another embodiment of the invention shown at 50. This embodiment 50 likewise includes an elongated arcuately formed stem 52 which, as previously described, has a generally straight configuration and the plan view wherein, in this direction, the stem 52 lies in a plane. The handle, similar to either previously described, is not shown.

The bristles 56 of the scrubbing head 54 in this embodiment 50 define an arcuate or cylindrical scrubbing surface 56 to provide an alternate scrubbing surface configuration as desired.

Molded plastic is the preferred construction material although other such material suitable for the purpose may be utilized. To facilitate back scratching without clothes removal, the smaller scratching head 20 of embodiment 10 is preferred. Again, the arcuate configuration of the invention as shown at 10 in FIG. 11 is ideally structured to accommodate the curvature of the shoulders, upper back and lower back so that effective scratching pressure and movement of the scratching head 20 and its flexible bristle array 22 are facilitated.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A back scratcher comprising:

an elongated stem having an elongated generally v-shaped handle disposed at a first end thereof and a scratching head disposed at a second end of said stem;

said stem having a substantially arcuate form defined by a radius of about 2 feet, said handle and said scratching head being oriented at an obtuse angle of about 140° one to another thereby;

said scratching head having bristles extending substantially orthogonally from said scratching head to define a scratching surf;

said handle having a first and second elongated handle portion extending in a first and second direction, respectively in splayed fashion at an obtuse angle with respect to said stem whereby, when said handle is grasped with first said handle portion placed against the palm of the user and a finger is positioned along said second handle portion and said stem is placed over the shoulder or around the waist, said bristles are aligned to engage the back of the user.

2. A back scratcher as set forth in claim 1, wherein:

said first and second handle portions each include an enlarged substantially spherically shaped distal portion thereof which provide added movement control of said scratching head.

3. In a back scratcher having an elongated stem with a handle disposed at a first end of said stem and a scratching head disposed at a second end of said stem, an improvement comprising:

said stem having a substantially continuous arcuate form, whereby said accurate form display said handle and said scratching head at an obtuse angle one to another thereby;

said scratching head having bristles extending laterally from said scratching head;

said handle having first and second elongated substantially continuous handle portions extending in a first and second direction from said first end and a plane defined by said stem whereby, when said handle is grasped with said first handle portion placed against the palm of the user and a finger is positioned along said second handle portion and said stem is placed over the shoulder or around the waist, said bristles are aligned to engage the back of the user.

4. A back scratcher as set forth in claim 3, wherein:

said arcuate form is defined by a substantially uniform radius.

5. A back scratcher as set forth in claim 3, further comprising:

an enlargement at a distal end of each said handle portion for enhanced gripping of said handle and manipulation of said scratching head.

6. A back scratcher as set forth in claim 3, wherein:

said first and second handle portions are oriented at an obtuse angle with respect to to said stem.

7. A back scratcher as set forth in claim 2, wherein: said first and second ends are oriented at an obtuse angle of about 140° one to another.

8. A back scratcher as set forth in claim 9, wherein:

said first and second handle portions each include an enlarged substantially spherically shaped distal portion thereof which provide added movement control of said scratching head.

9. A back scratcher manipulatable by grasping a handle disposed at a first end of an elongated stem to apply a scratching head disposed at a second end of said stem against a users back comprising:

said stem having a substantially continuous arcuate form, wherein by said stem having said handle and said scratching head being oriented at an obtuse angle one to another thereby;

said scratching head having bristles extending substantially orthogonally from said scratching head;

said handle having first and second elongated substantially continuous handle portions extending in a first and second direction, respectively, from said first end whereby, when said handle is grasped with said first handle portion placed against the palm of the user and a finger is positioned along said second handle portion and said stem is placed over the shoulder or around the waist, said bristles are aligned to engage the back of the user.

10. A back scratcher as set forth in claim 9, wherein;

said first and second handle portions each include an enlarged substantially spherically shaped distal portion thereof which provide added movement control of said scratching head.

11. A back scratcher comprising:

an elongated stem having an elongated generally v-shaped handle disposed at a first end thereof and a scratching head disposed at a second end of said stem;

said stem having a substantially continuous arcuate form, said handle and said scratching head being oriented at an obtuse angle one to another thereby;

said scratching head having bristles extending substantially orthogonally from said scratching head to define a scratching surface;

said handle having a first and second elongated handle portion of substantially equal length and substantially continuous in cross sectional shape, said first and second handle portions extending in a first and second direction, respectively, in splayed fashion at substantially equal acute angles with respect to said stem whereby, when said handle is grasped with first handle portion placed against the palm of the user and a finger is positioned along said second handle portion and said stem is placed over the shoulder or around the waist, said bristles are aligned to engage the back of the user.

12. A back scratcher as set forth in claim 10, wherein;

said first and second handle portions each include an enlarged substantially spherically shaped distal portion thereof which provide added movement control of said scratching head.

* * * * *

UNITED STATES PATENT AND TRADEMARK OFFICE

CERTIFICATE OF CORRECTION

PATENT NO. : 6,221,034 B1
DATED : April 24, 2001
INVENTOR(S) : Albin Chaplin

It is certified that error appears in the above-identified patent and that said Letters Patent is hereby corrected as shown below:

Column 2,
Last line, rewrite "1400" as -- 140° --.

Column 4,
Line 12, rewrite "surf" as -- surface --.
Line 32, rewrite "display" as -- displaces --.

Column 5,
Line 3, after "form,", insert -- whereby said arcuate form displaces --.
Line 4, delete "wherein by said stem having".
Line 5, delete "being oriented".

Column 6,
Line 12, rewrite "acute" as -- obtuse --.

Signed and Sealed this

Sixth Day of November, 2001

*Attest:*

Nicholas P. Godici

*Attesting Officer*

NICHOLAS P. GODICI
*Acting Director of the United States Patent and Trademark Office*